US007814949B2

(12) United States Patent
Surface et al.

(10) Patent No.: US 7,814,949 B2
(45) Date of Patent: Oct. 19, 2010

(54) HANDBAGS WITH MULTI-FUNCTION STRAP SYSTEM

(75) Inventors: Lyssa L. Surface, Lenexa, KS (US); Jessica L. Schifman, Overland Park, KS (US)

(73) Assignee: L&J Design House, LLC, Shawnee Mission, KS (US)

( * ) Notice: Subject to any disclaimer, the term of this patent is extended or adjusted under 35 U.S.C. 154(b) by 88 days.

(21) Appl. No.: 12/246,898

(22) Filed: Oct. 7, 2008

(65) Prior Publication Data

US 2009/0090442 A1 Apr. 9, 2009

Related U.S. Application Data

(60) Provisional application No. 60/978,216, filed on Oct. 8, 2007.

(51) Int. Cl.
*A41D 27/20* (2006.01)

(52) U.S. Cl. ..... 150/110; 150/107; 150/100; 224/578; 224/585

(58) Field of Classification Search ..... 150/100, 150/107, 110, 3, 1.7, 12, 102, 134; 224/219, 224/578, 267, 579, 616, 617, 614, 258, 31, 224/55, 202, 209
See application file for complete search history.

(56) References Cited

U.S. PATENT DOCUMENTS 909,248 A * 1/1909 Staeger ..... 383/2
2,677,834 A * 5/1954 Moynihan ..... 128/872
2,972,820 A * 2/1961 Cano ..... 434/260
4,240,480 A * 12/1980 Strobel ..... 383/15
4,489,815 A * 12/1984 Martinez et al. ..... 190/1
4,574,990 A * 3/1986 Remis ..... 224/255
5,197,525 A * 3/1993 Cantor ..... 150/102
5,285,833 A * 2/1994 Haxby ..... 150/102
6,299,044 B1 * 10/2001 Klindworth-Garron ..... 224/625
7,090,500 B1 * 8/2006 Guttman ..... 434/260

* cited by examiner

*Primary Examiner*—Anthony Stashick
*Assistant Examiner*—Cynthia F Collado
(74) *Attorney, Agent, or Firm*—Lathrop & Gage LLP

(57) ABSTRACT

Handbags with multi-function strap systems and methods of utilizing handbags with multi-function strap systems are provided herein. According to one embodiment, a handbag with multi-function strap system includes a bag portion having an inside and an outside, a ring coupled to one side of the bag, and first and second fasteners coupled to the bag portion. The first and second fasteners are accessible at the inside of the bag, the first fastener is relatively distant to the ring, and the second fastener is relatively near the ring. A strap has first and second ends, and a hook is coupled to the strap adjacent the first end. A third fastener complementary to at least one of the first and second fasteners is coupled to the strap adjacent the strap second end. A fourth fastener complementary to at least one of the first and second fasteners is also coupled to the strap.

14 Claims, 10 Drawing Sheets

HANDBAGS WITH MULTI-FUNCTION STRAP SYSTEM

RELATED APPLICATIONS

The present application claims benefit of priority to provisional U.S. Patent Application No. 60/978,216, filed Oct. 8, 2007 and titled "Handbags With Multi-Function Strap System", which is incorporated herein by reference.

BACKGROUND

The current invention relates to handbags. More particularly, the invention relates to handbags with multi-function strap systems that may provide various configurations, such as shoulder bag, wristlet, clutch, and attachment configurations.

SUMMARY

Handbags with multi-function strap systems and methods of utilizing handbags with multi-function strap systems are provided herein. According to one embodiment, a handbag with multi-function strap system includes a bag portion having an inside and an outside, a ring coupled to one side of the bag, and first and second fasteners coupled to the bag portion. The first and second fasteners are accessible at the inside of the bag, the first fastener is relatively distant to the ring, and the second faster is relatively near to the ring. A strap has first and second ends, and a hook is coupled to the strap adjacent the strap first end. A third fastener is coupled to the strap adjacent the strap second end. The third fastener is complementary to the first and second fasteners. A fourth fastener is also coupled to the strap. The fourth fastener is complimentary to the first and second fasteners.

According to another embodiment, a handbag with multi-function strap system includes a bag portion having an inside and an outside, a ring coupled to one side of the bag, and first and second fasteners coupled to the bag portion. The first and second fasteners are accessible at the inside of the bag, the first fastener is relatively distant to the ring, and the second fastener is relatively near the ring. A strap has first and second ends, and a hook is coupled to the strap adjacent the strap first end. A third fastener is coupled to the strap adjacent the strap second end. The third fastener is complementary to at least one of the first and second fasteners. A fourth fastener is also coupled to the strap. The fourth fastener is complementary to at least one of the first and second fasteners.

According to still another embodiment, a handbag with multi-function strap system includes a bag portion having an inside and an outside, a ring coupled to one side of the bag, and first and second fasteners coupled to the bag portion. The first and second fasteners are accessible at the inside of the bag, the first fastener is relatively near one side of the bag, and the second fastener is relatively near an opposed side of the bag. A strap has first and second ends. A third fastener is coupled to the strap adjacent the strap second end. The third fastener is complementary to at least one of the first and second fasteners. A fourth fastener is also coupled to the strap. The fourth fastener is complementary to at least one of the first and second fasteners.

DETAILED DESCRIPTION

Figure 1:
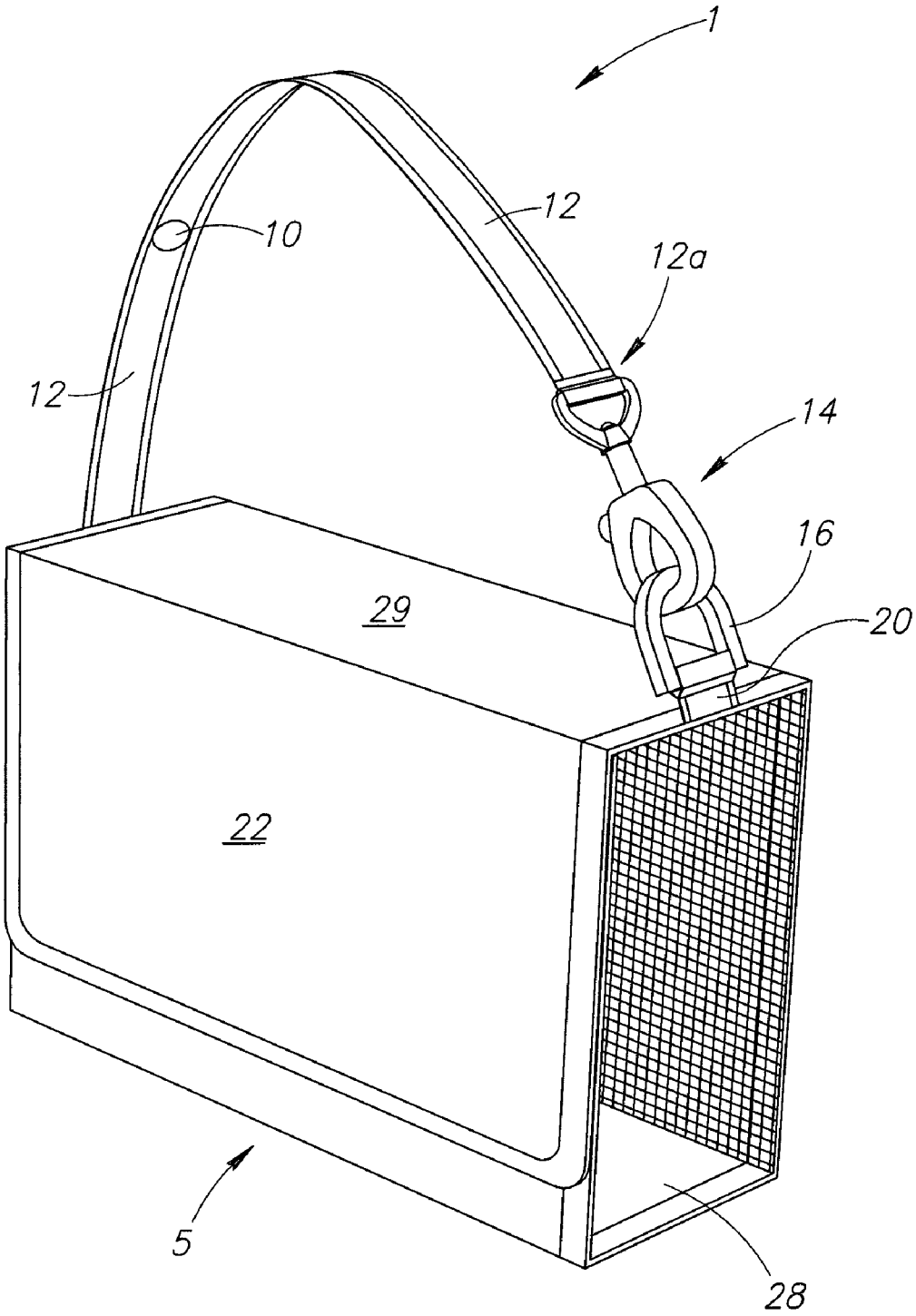
FIG. 1 is a perspective view of an embodiment of a handbag with multi-function strap system, with the strap attached according to a first configuration.

There are several handbags on the market used to contain and transport items. Those prior-art handbags are generally constructed in light of functionality and/or fashion considerations. Depending on these functionality and/or fashion considerations, each handbag is given a specific strap, or the strap is forgone altogether. "Handbag" is used herein to refer to a purse, clutch, tote, pocketbook, satchel, shoulder bag, wristlet, diaper bag, and any similar items.

FIGS. 1 through 8 show a handbag with multi-function strap system 1 having a bag portion 5 and a strap 12. As discussed below, the strap 12 is attached according to a first configuration in FIGS. 1 through 3, according to a second configuration in FIGS. 4 through 6, according to a third configuration in FIG. 7, and is entirely detached in FIG. 8.

Figure 2:
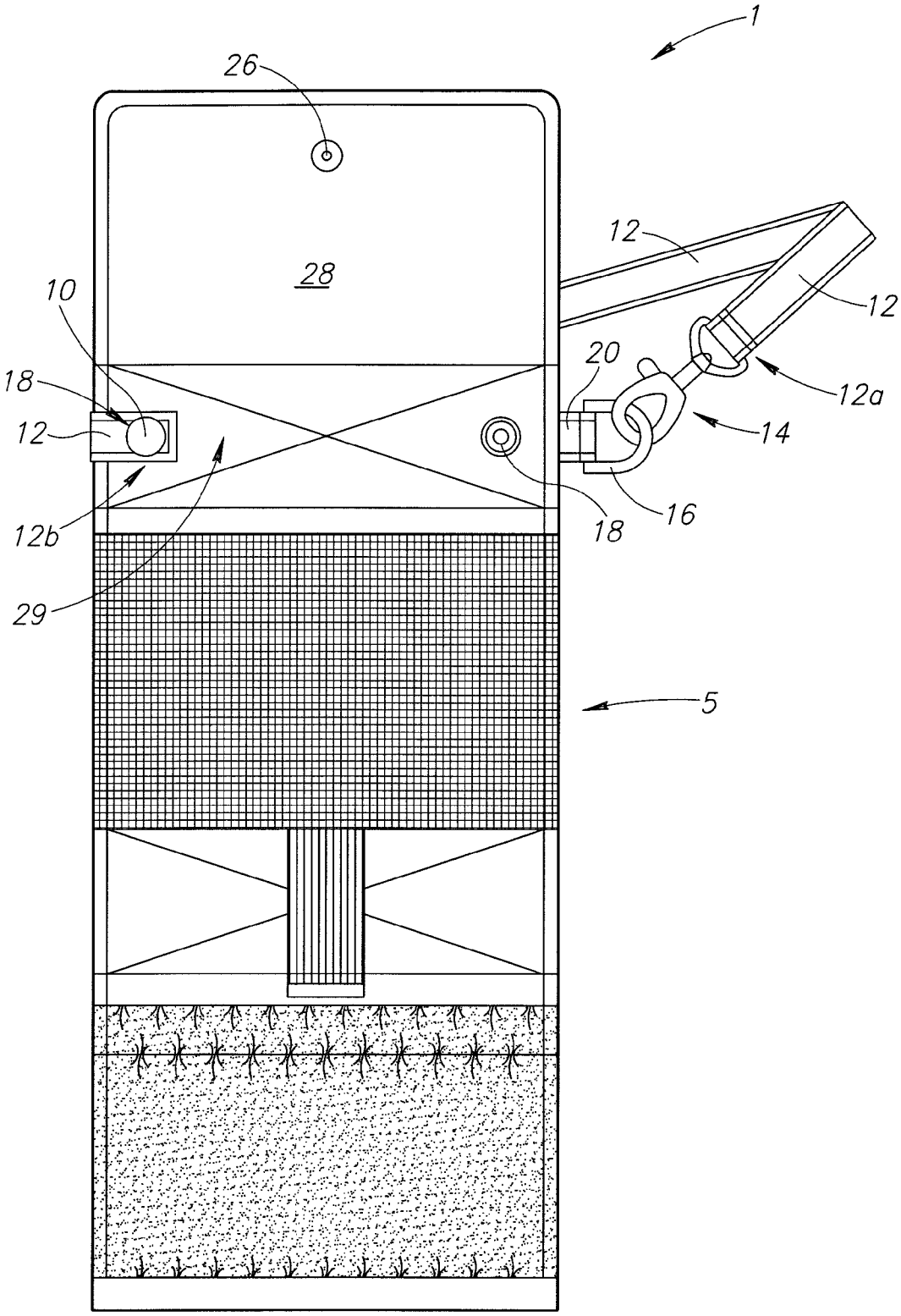
FIG. 2 is a front view of the handbag with multi-function strap system of FIG. 1, with the handbag unfolded to show the attachment of the strap according to the first configuration.
Figure 3:
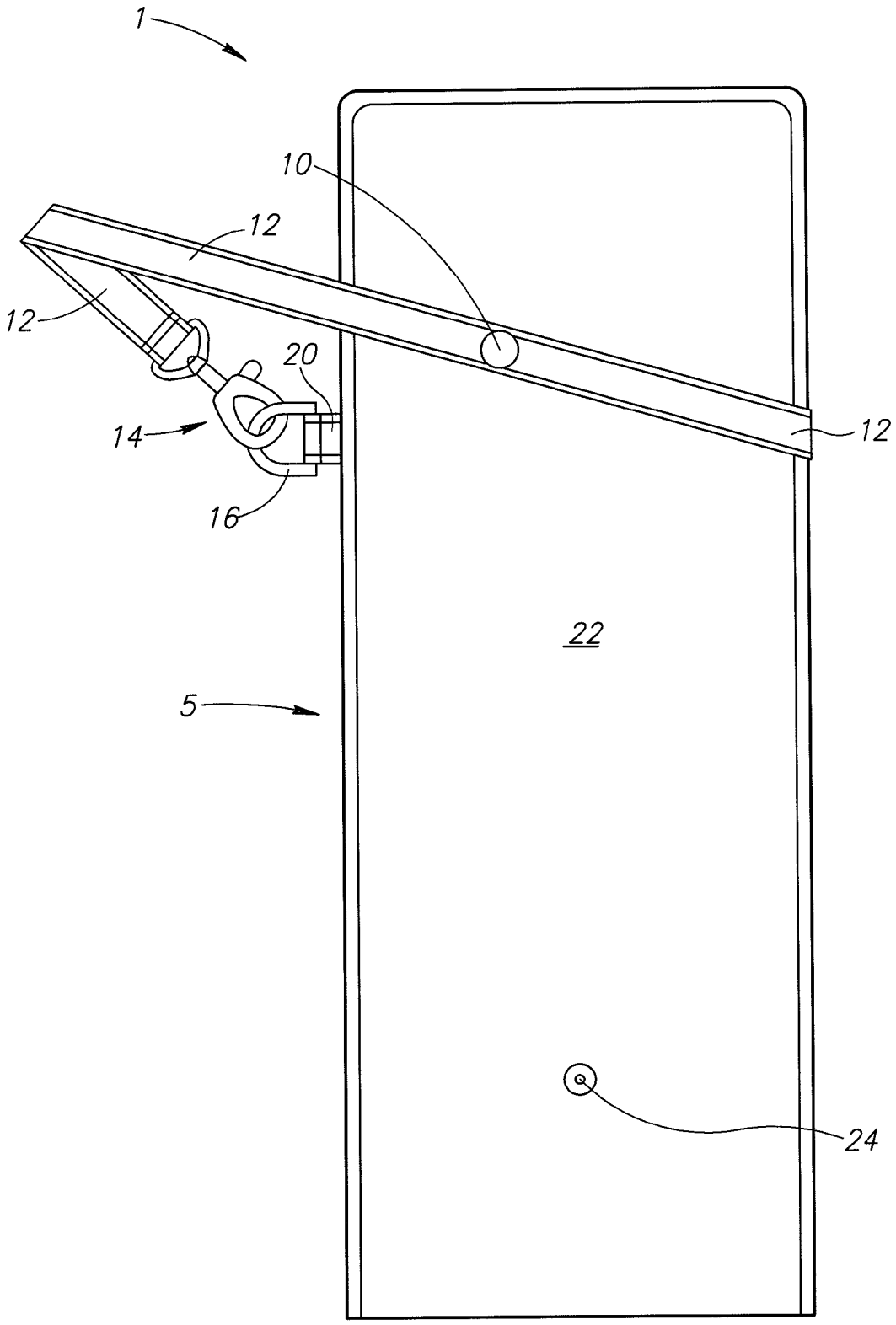
FIG. 3 is a rear view of the handbag with multi-function strap system of FIG. 1, with the handbag unfolded to show the attachment of the strap according to the first configuration.

The bag portion 5 has an inside 28, an outside 22, and a fastening assembly 24, 26 (FIGS. 2 and 3). The fastening assembly 24, 26 (e.g., a magnetic fastening assembly, clasp, zipper, or any other desired fastening assembly) may selectively maintain the bag portion 5 at a closed configuration, as shown in FIGS. 1, 4, 7, and 8. The bag portion 5 may be constructed of leather, vinyl, synthetic fabrics, non-synthetic fabrics, and/or any other appropriate material. Construction from durable, lightweight materials may be preferred but is not required. A ring 16 (e.g. a "D-ring") may be connected to one side of the bag portion 5 (e.g., by a strap 20).

The inside 28 of the bag portion 5 includes two fasteners 18 (e.g., snaps, magnets, buttons, hook and loop fasteners, etc.), and the strap 12 includes two complementary fasteners 10. For example, the fasteners 18 may be female snap elements and the fasteners 10 may be male snap elements, the fastener 18 may be magnets with negative attraction and the fasteners 10 may be magnets with positive attraction, the fasteners 18 may be buttons and the fasteners 10 may be button holes, or the fasteners 18 may be hook fasteners and the fasteners 10 may be loop fasteners. An upper section 29 of the bag portion 5 extends continuously between the fasteners 18 and the ring 16, as shown for example in FIGS. 1 and 2.

The strap 12 has opposed ends 12*a*, 12*b*, and a swivel hook 14 may be attached to the strap end 12*a*. One of the fasteners 10 is adjacent the strap end 12*b*, and the other fastener 10 is located so that both fasteners 10 can be simultaneously coupled to the fasteners 18. The strap 12 may be constructed of leather, vinyl, synthetic fabrics, non-synthetic fabrics, and/or any other appropriate material. Construction from durable, lightweight materials may be preferred but is not required.

To attach the strap 12 to the bag portion 5 according to the first configuration (i.e. to provide a shoulder bag, as shown in FIGS. 1 through 3), the fastener 10 adjacent the strap end 12*b* is coupled to the fastener 18 furthest from the ring 16, the swivel hook 14 is coupled to the ring 16, and the strap 12 is positioned to extend outside the bag portion 5. In this configuration, the upper section 29 is between the bag inside 28 and a portion of the strap 12, as shown in FIG. 1. To shorten an amount of the strap 12 extending outside the bag portion 5, the fastener 10 adjacent the strap end 12*b* may instead be coupled to the fastener 18 closest to the ring 16, the other fastener 10 may be coupled to the fastener 18 furthest from the ring 16, the swivel hook 14 may be coupled to the ring 16, and the strap 12 may be positioned to extend outside the bag portion 5.

Figure 4:
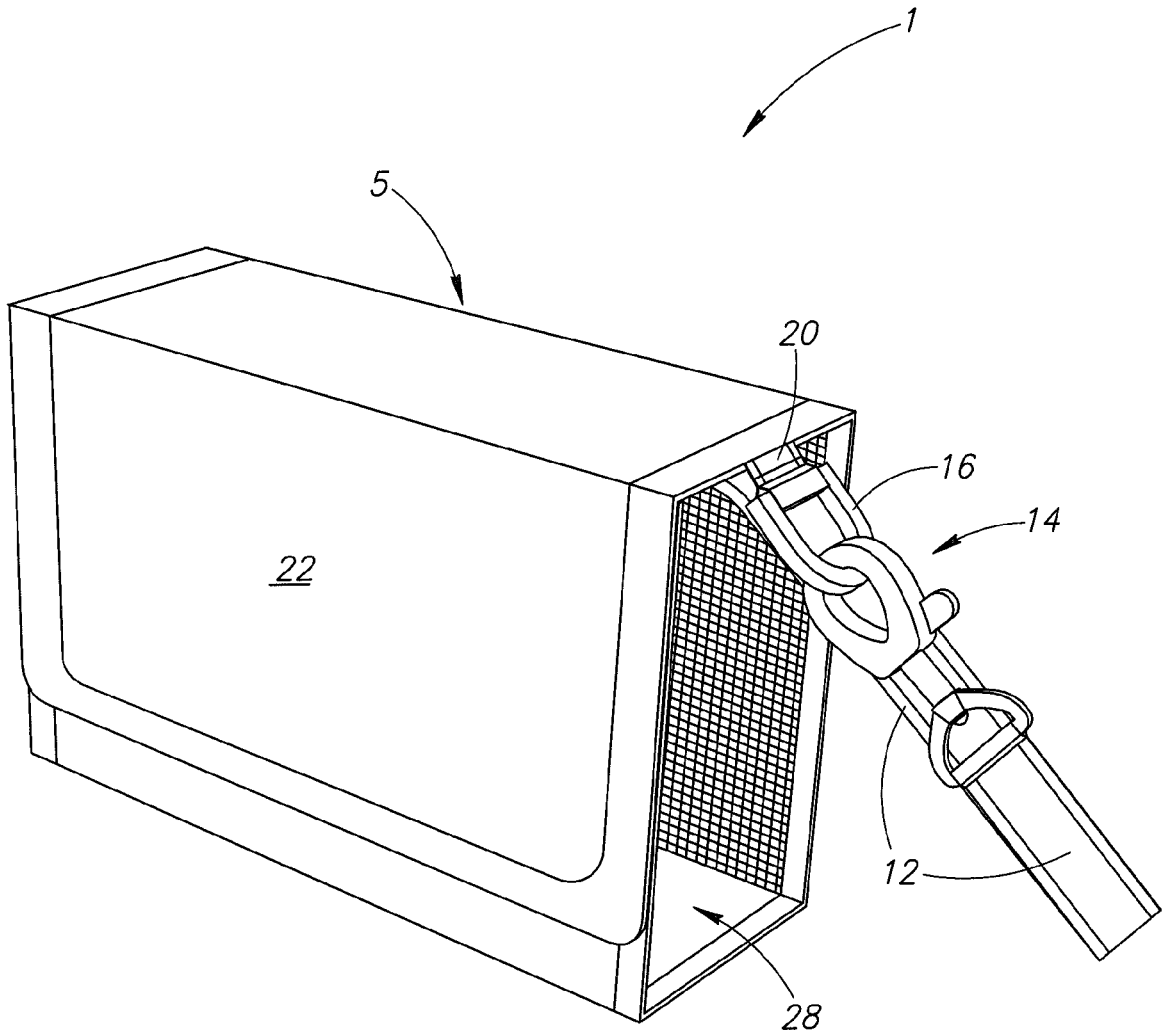
FIG. 4 is a perspective view of the handbag with multi-function strap system of FIG. 1, with the strap attached according to a second configuration.
Figure 5:
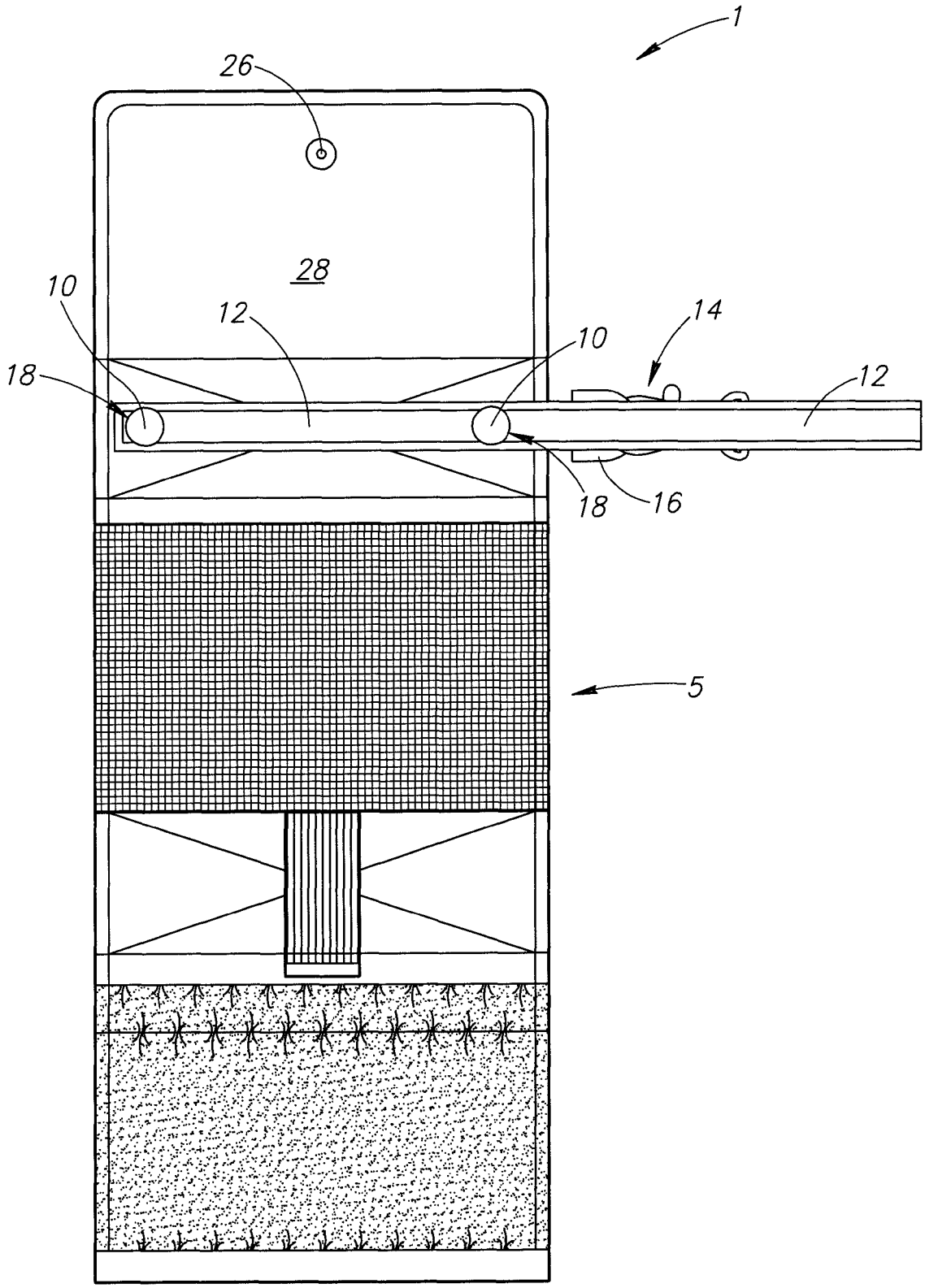
FIG. 5 is a front view of the handbag with multi-function strap system of FIG. 1, with the handbag unfolded to show the attachment of the strap according to the second configuration.
Figure 6:
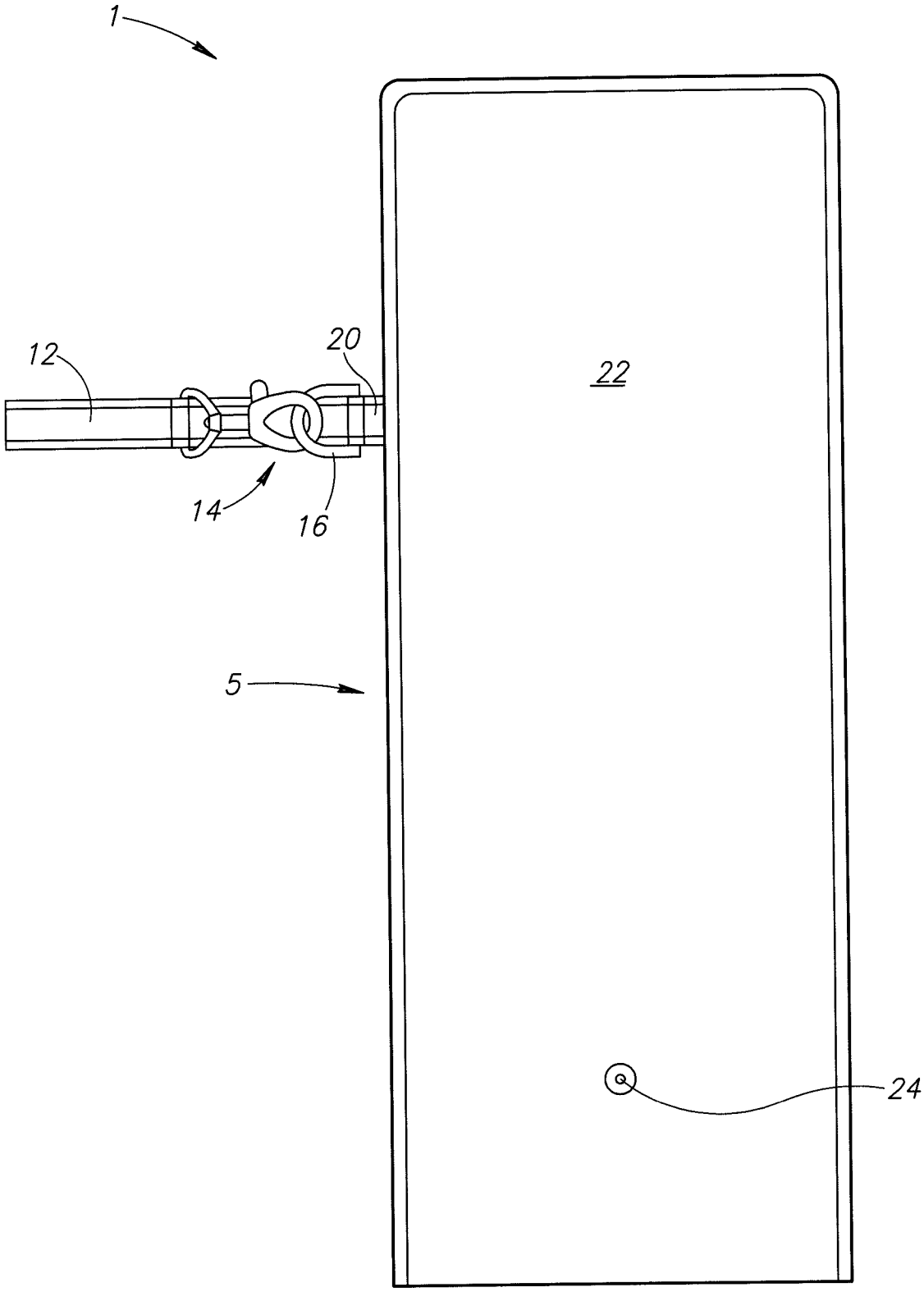
FIG. 6 is a rear view of the handbag with multi-function strap system of FIG. 1, with the handbag unfolded to show the attachment of the strap according to the second configuration.

To attach the strap 12 to the bag portion 5 according to the second configuration (i.e., to provide a wristlet as shown in FIGS. 4 through 6), the fastener 10 adjacent the strap end 12*b* is coupled to the fastener 18 furthest from the ring 16, the swivel hook 14 is coupled to the ring 16, and the remaining fasteners 10, 18 are coupled together. This configuration forces the strap 12 to extend along the inside 28 of the bag portion 5, and the upper section 29 is not between the bag inside 28 and the strap 12, as shown in FIG. 4. The length of the strap 12 between the hook 14 and the fastener 10 closest to the hook 14 may be selected to allow the strap 12 to be comfortably worn around a user's wrist when attached according to the second configuration.

Figure 7:
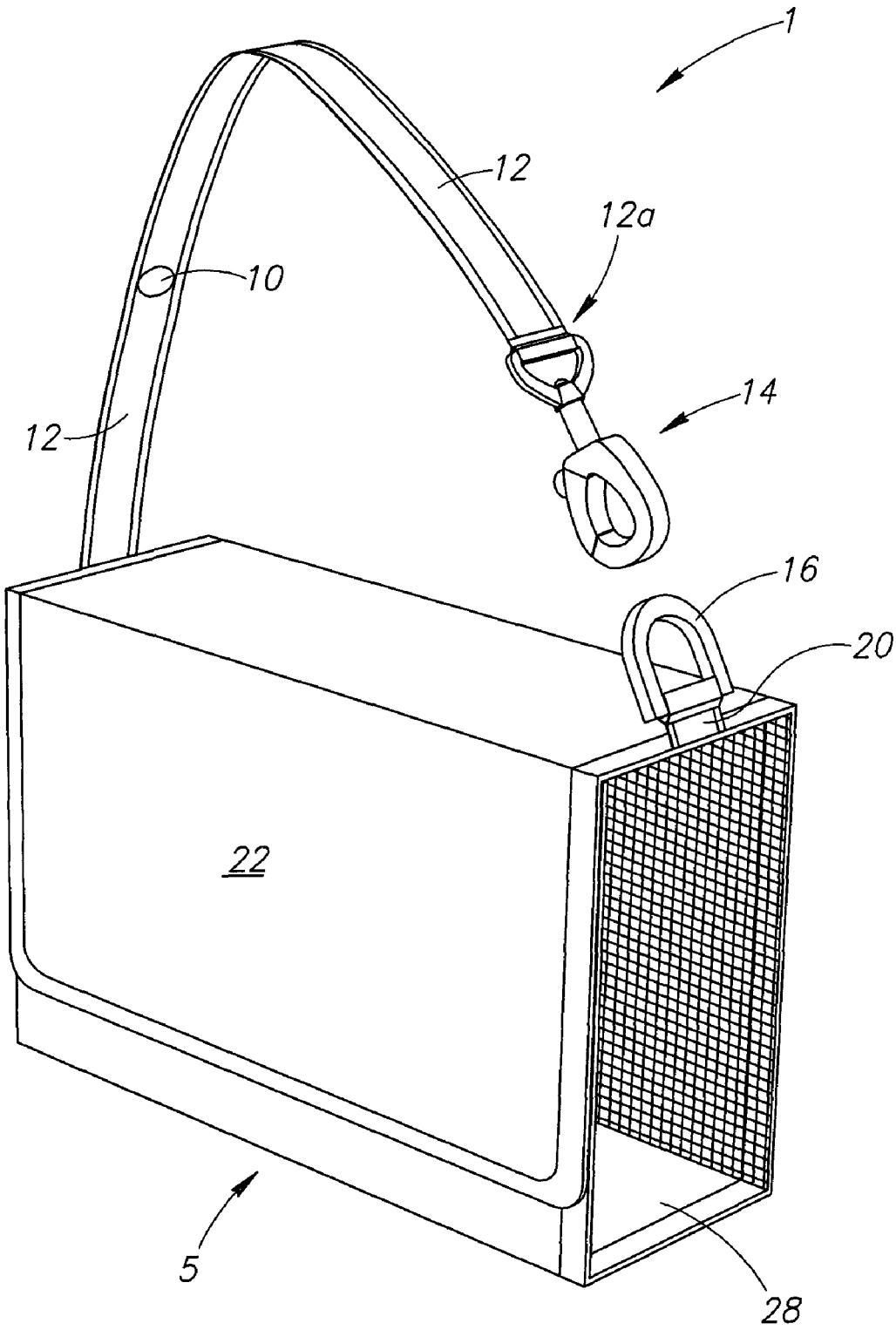
FIG. 7 is a perspective view of the handbag with multi-function strap system of FIG. 1, with the strap hook detached from the ring according to a third configuration.

To attach the strap 12 to the bag portion 5 according to the third configuration (i.e., to provide an attachment configuration as shown in FIG. 7), one strap fastener 10 may be coupled to one fastener 18 (e.g., as set forth above in relation to FIGS. 1 through 3). Alternately, though not shown in the accompanying drawings, both strap fasteners 10 may be coupled to both fasteners 18 (e.g., as set forth above in relation to FIGS. 4 through 6). Regardless, the hook 14 is not attached to the ring 16, and is instead free to be coupled to another article (e.g., luggage, a diaper bag, etc.).

Figure 8:
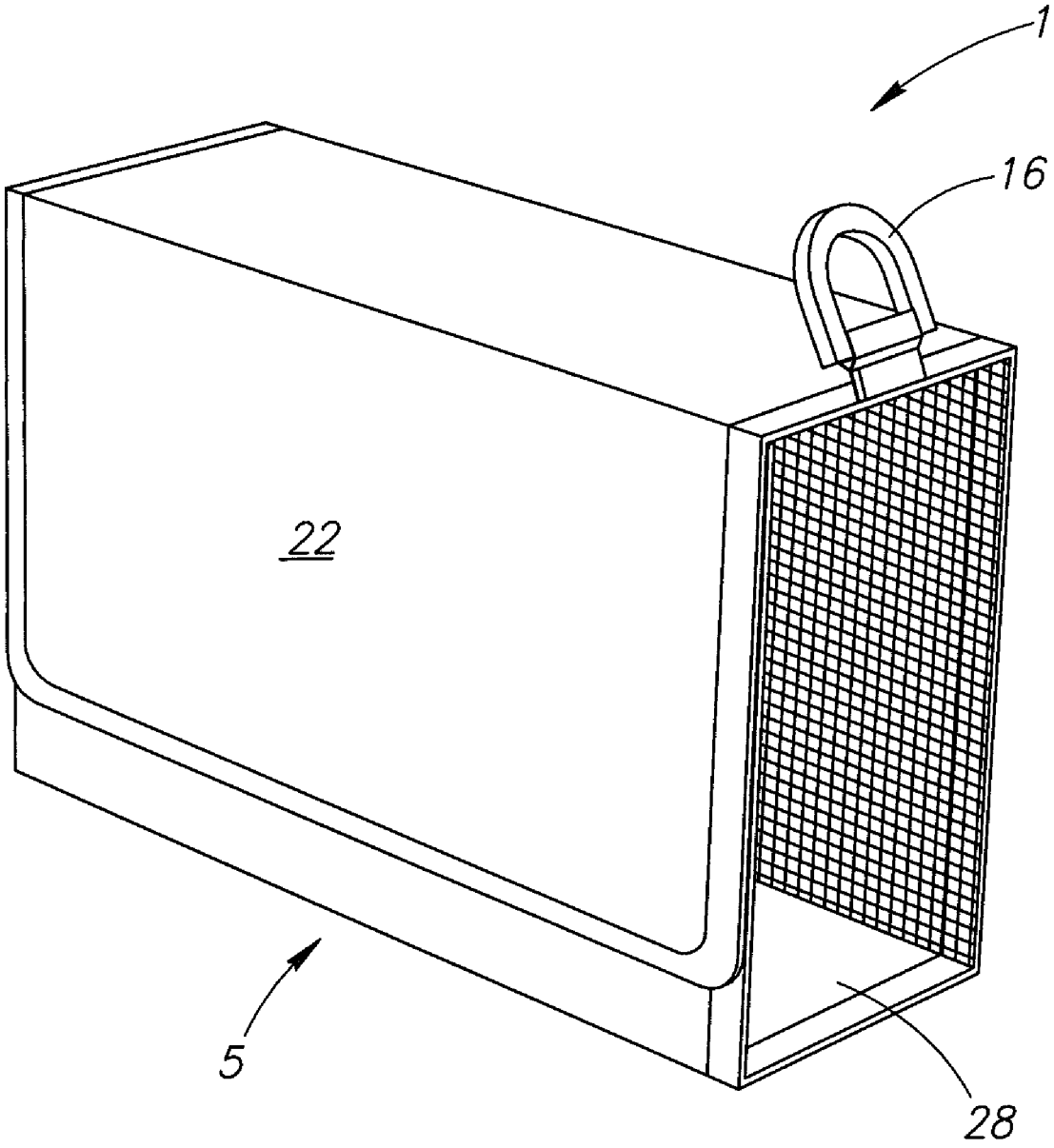
FIG. 8 is a perspective view of the handbag with multi-function strap system of FIG. 1, with the strap completely detached.

As shown in FIG. 8, the strap 12 may be entirely removed from the bag portion 5 to allow the bag portion 5 to function as a clutch. In this configuration, the hook 14 is separated from the ring 16, and the fasteners 10 are separated from the fasteners 18.

Figure 9:
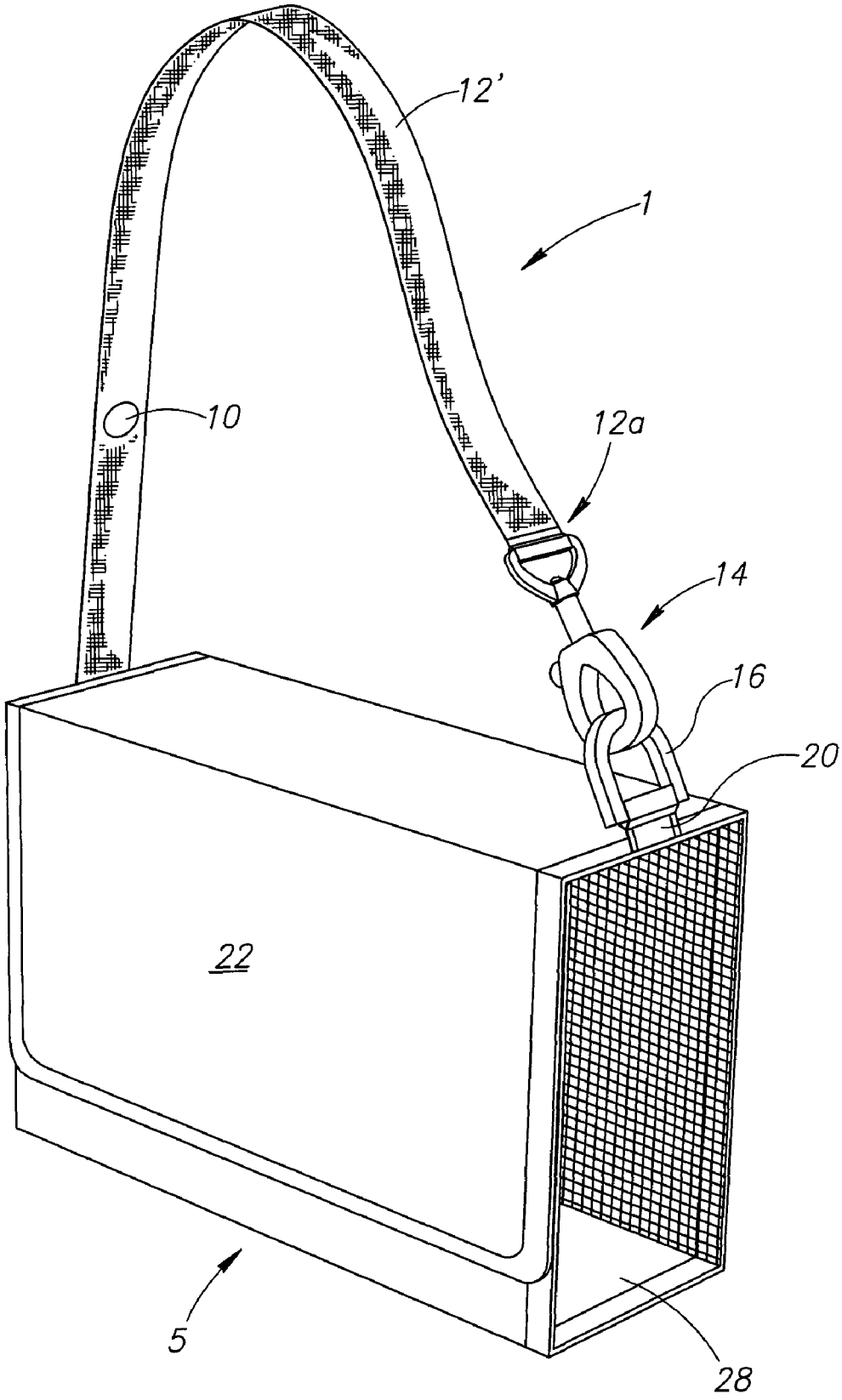
FIG. 9 is a perspective view of a second embodiment of a handbag with multi-function strap system, with the strap attached as in FIG. 1.

FIG. 9 shows that an additional strap 12' may be included in the multi-function strap system 1. The strap 12' may be constructed of different materials than the strap 12, may be a different color than the strap 12, or may otherwise be distinct from the strap 12. But as in the strap 12, the strap 12' includes two fasteners 10 spaced apart to simultaneously interact with the fasteners 18 (e.g., as shown in FIGS. 4 through 6 regarding the strap 12) if desired. As such, it should be clear that the strap 12' (instead of the strap 12) may be coupled to the bag portion 5 to provide a shoulder bag as shown in FIG. 9 and functionally described above regarding the strap 12 (FIGS. 1 through 3), may be coupled to the bag portion 5 to provide a wristlet as functionally described above regarding the strap 12 (FIGS. 4 through 6), may be coupled to the bag portion 5 to provide an attachment configuration as functionally described above regarding the strap 12 (FIG. 7), or may be separated from the bag portion 5 to allow the bag portion 5 to function as a clutch (FIG. 8).

Figure 10:
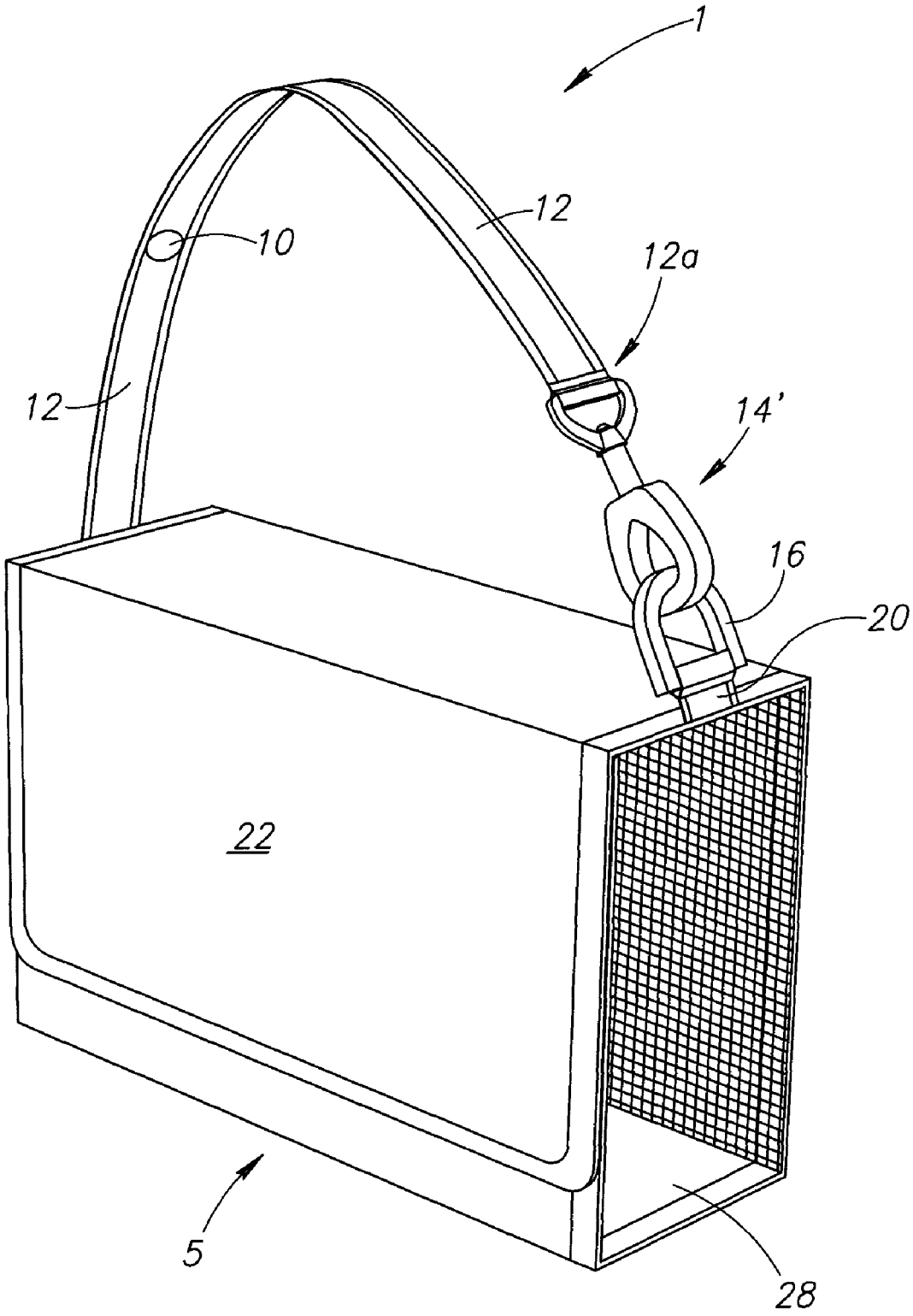
FIG. 10 is a perspective view of a third embodiment of a handbag with multi-function strap system, with the strap attached generally as in FIG. 1.

FIG. 10 shows that the hook 14 may be replaced by a ring 14' (e.g., a swivel ring) that is permanently coupled to the ring 16. If the ring 14' replaces the hook 14, it should be understood that the strap 12 cannot be interchanged with the strap 12', that the strap 12 cannot be separated from the bag portion 5 to provide a clutch configuration, and that the strap 12 cannot provide an attachment configuration. However, the strap 12 may still be coupled to the bag portion 5 using the fasteners 10, 18 to provide a shoulder bag (as shown in FIG. 10 and functionally described above regarding FIGS. 1 through 3) and to provide a wristlet configuration (as functionally described above regarding FIGS. 4 through 6).

Whether the hook 14 or the ring 14' is used, it should be appreciated that the fastener 10 adjacent the strap end 12*b* may be permanently coupled to the fastener 18 furthest from the ring 16 (e.g., by a rivet or other appropriate fastener). In such embodiments, the remaining fasteners 10, 18 could interact to provide a shoulder bag (as functionally described above regarding FIGS. 1 through 3) or to provide a wristlet configuration (as functionally described above regarding FIGS. 4 through 6). If the hook 14 is used, the attachment configuration may also be provided (as functionally described above regarding FIG. 7).

In using the handbags with the multi-function strap system 1, a user may alter the attachment of the strap 12 to the bag portion 5 as set forth above to obtain a configuration that is most desirable at any given time. In addition, a manufacturer may realize cost savings because only one strap 12 is required to provide multiple bag configurations; some prior art handbags require multiple distinct straps to allow the handbags to function in a variety of ways.

Those skilled in the art appreciate that variations from the specified embodiments disclosed above are contemplated herein and that the described embodiments are not limiting. The description should not be restricted to the above embodiments, but should be measured by the following claims.

What is claimed is:

1. A handbag with multi-function strap system, comprising:

a bag portion having an inside and an outside;

a ring coupled to one side of the bag;

first and second fasteners coupled to the bag portion, the first and second fasteners being operative at the inside of the bag, the first fastener being relatively distant to the ring, the second fastener being relatively near to the ring, an upper section of the bag portion extending continuously between the first and second fasteners and the ring;

a strap having first and second ends;

a hook coupled to the strap adjacent the strap first end;

a third fastener coupled to the strap adjacent the strap second end, the third fastener being complimentary to the first and second fasteners; and a fourth fastener coupled to the strap, the fourth fastener being complimentary to the first and second fasteners.

2. The handbag of claim 1, wherein to provide a shoulder bag configuration:

the third fastener is coupled to the first fastener;

the hook is coupled to the ring;

the strap extends primarily outside the bag portion; and the upper section is between the bag inside and a portion of the strap.

3. The handbag of claim 1, wherein to provide a wristlet configuration:

the third fastener is coupled to the first fastener;

the fourth fastener is coupled to the second fastener;
and the hook is coupled to the ring.

4. The handbag of claim 1, wherein the strap is entirely separable from the bag portion to provide a clutch configuration.

5. The handbag of claim 1, wherein the third fastener is coupled to the first fastener and the hook is separated from the ring to provide an attachment configuration.

6. The handbag of claim 1, wherein:
to provide a shoulder bag configuration:
the third fastener is coupled to the first fastener;
the hook is coupled to the ring;
the strap extends primarily outside the bag portion; and
the upper section is between the bag inside and a portion of the strap;
to provide a wristlet configuration:
the third fastener is coupled to the first fastener;
the fourth fastener is coupled to the second fastener;
and the hook is coupled to the ring;
the strap is entirely separable from the bag portion to provide a clutch configuration; and
the third fastener is coupled to the first fastener and the hook is separated from the ring to provide an attachment configuration.

7. The handbag of claim 1, wherein the first and second fasteners are on the same plane.

8. The handbag of claim 1, wherein the first, second, third, and fourth fasteners each includes at least one of a snap, magnet, hook and loop fastener, or button.

9. The handbag of claim 1, further comprising:
a second strap having first and second ends;
a hook coupled to the second strap adjacent the first end of the second strap;
another fastener coupled to the second strap adjacent the second end of the second strap, the another fastener being complementary to the first and second fasteners; and
still another fastener coupled to the second strap, the still another fastener being complementary to the first and second fasteners;
wherein a length between the another fastener and the still another fastener is identical to a length between the third and fourth fasteners; and
wherein a length between the still another fastener and the first end of the second strap is longer or shorter than a length between the fourth fastener and the first end of the first strap; and
wherein only one of the strap and the second strap is attached to the bag portion at one time.

10. A handbag with multi-function strap system, comprising:
a bag portion having an inside and an outside;
first and second fasteners coupled to the bag portion, the first and second fasteners being operative at the inside of the bag, the first fastener being relatively near one side of the bag, the second fastener being relatively near an opposed side of the bag;
a strap having a first and second ends;
a third fastener coupled to the strap adjacent the strap second end, the third fastener being complementary to at least one of the first and second fasteners;
a fourth fastener coupled to the strap, the fourth fastener being complimentary to at least one of the first and second fasteners; and
a ring coupled to one side of the bag and a ring coupled to the strap adjacent the strap first end, wherein the ring coupled to the bag portion and the ring coupled to the strap portion are permanently coupled together.

11. The handbag of claim 7, wherein the first and second fasteners and the hook are generally collinear.

12. The handbag of claim 11, wherein:
the strap is entirely separable from the bag portion to provide a clutch configuration; and
the third fastener is coupled to the first fastener and the hook is separated from the ring to provide an attachment configuration.

13. A handbag with multi-function strap system, comprising:
a bag portion having an inside and an outside, only one strap being coupled to the bag portion at a time;
a ring coupled to one side of the bag;
first and second fasteners coupled to the bag portion, the first and second fasteners being operative at the inside of the bag, the first fastener being relatively distant to the ring, the second fastener being relatively near to the ring, an upper section of the bag portion extending continuously between the first and second fasteners and the ring;
a respective strap having first and second ends;
a hook coupled to the strap adjacent the strap first end;
a third fastener coupled to the strap adjacent the strap second end, the third fastener being complimentary to the first and second fasteners; and
a fourth fastener coupled to the strap, the fourth fastener being complimentary to the first and second fasteners.

14. The handbag of claim 13, wherein:
to provide a shoulder bag configuration:
the third fastener is coupled to the first fastener;
the hook is coupled to the ring;
the strap extends primarily outside the bag portion; and
the upper section is between the bag inside and a portion of the strap; and
to provide a wristlet configuration:
the third fastener is coupled to the first fastener;
the fourth fastener is coupled to the second fastener;
the hook is coupled to the ring; and
and the hook is coupled to the ring.

* * * * *